US009416652B2

(12) United States Patent
Plotnikov et al.

(10) Patent No.: US 9,416,652 B2
(45) Date of Patent: Aug. 16, 2016

(54) SENSING MAGNETIZED PORTIONS OF A WELLHEAD SYSTEM TO MONITOR FATIGUE LOADING

(71) Applicant: Vetco Gray Inc., Houston, TX (US)

(72) Inventors: Yuri Alexeyevich Plotnikov, Niskayuna, NY (US); Teresa Chen-Keat, Niskayuna, NY (US); Yanyan Wu, Houston, TX (US); Chad Eric Yates, Houston, TX (US); Xichang Zhang, Houston, TX (US); Li Zheng, Niskayuna, NY (US); Pinghai Yang, Niskayuna, NY (US)

(73) Assignee: Vetco Gray Inc., Houston, TX (US)

( * ) Notice: Subject to any disclaimer, the term of this patent is extended or adjusted under 35 U.S.C. 154(b) by 479 days.

(21) Appl. No.: 13/962,413

(22) Filed: Aug. 8, 2013

(65) Prior Publication Data

US 2015/0041119 A1 Feb. 12, 2015

(51) Int. Cl.

| | |
|---|---|
| ***E21B 47/12*** | (2012.01) |
| ***E21B 33/03*** | (2006.01) |
| ***E21B 47/00*** | (2012.01) |

(52) U.S. Cl.

CPC ..... *E21B 47/12* (2013.01); *E21B 33/03* (2013.01); *E21B 47/0006* (2013.01)

(58) Field of Classification Search

CPC .... E21B 47/0006; E21B 47/12; E21B 47/122
See application file for complete search history.

(56) References Cited

U.S. PATENT DOCUMENTS

| | | | |
|---|---|---|---|
| 2,001,023 | A | 5/1935 | Howell et al. |
| 2,814,019 | A | 11/1957 | Bender |
| 3,255,627 | A | 6/1966 | Doig et al. |
| 3,359,791 | A | 12/1967 | Pantages |
| 3,376,921 | A | 4/1968 | Manry et al. |

(Continued)

FOREIGN PATENT DOCUMENTS

| | | | |
|---|---|---|---|
| DE | 3744194 | A1 | 7/1989 |
| DE | 19654572 | A1 | 7/1997 |

(Continued)

OTHER PUBLICATIONS

International Search Report and Written Opinion issued in connection with corresponding PCT Application No. PCT/US2014/050064 dated May 7, 2015.

(Continued)

*Primary Examiner* — William P Neuder
(74) *Attorney, Agent, or Firm* — Bracewell LLP; James E. Bradley

(57) ABSTRACT

A wellhead assembly having a tubular magnetized in at least one selected location, and a sensor proximate the magnetized location that monitors a magnetic field from the magnetized location. The magnetic field changes in response to changes in mechanical stress of the magnetized location, so that signals from the sensor represent loads applied to the tubular. Analyzing the signals over time provides fatigue loading data useful for estimating structural integrity of the tubular and its fatigue life. Example tubulars include a low pressure housing, a high pressure housing, conductor pipes respectively coupled with the housings, a string of tubing, a string of casing, housing and tubing connections, housing and tubing seals, tubing hangers, tubing risers, and other underwater structural components that require fatigue monitoring, or can be monitored for fatigue.

18 Claims, 3 Drawing Sheets

(56) References Cited

U.S. PATENT DOCUMENTS 3,686,942 A 8/1972 Chatard et al.
3,693,419 A 9/1972 De Pierre et al.
3,817,094 A 6/1974 Montgomery et al.
3,824,851 A 7/1974 Hagar et al.
3,917,230 A 11/1975 Barron
3,936,231 A 2/1976 Douglas
3,938,381 A 2/1976 Rundell et al.
4,015,469 A 4/1977 Womack et al.
4,042,123 A 8/1977 Sheldon et al.
4,090,405 A 5/1978 McKee
4,109,969 A 8/1978 Reinecke
4,123,115 A 10/1978 King
4,138,882 A 2/1979 Lockery et al.
4,139,891 A 2/1979 Sheldon et al.
4,194,393 A 3/1980 Boley
4,365,509 A 12/1982 Cornelis
4,409,824 A 10/1983 Salama et al.
4,507,055 A 3/1985 Fair
4,626,954 A 12/1986 Damiano et al.
4,630,868 A 12/1986 Jones et al.
4,658,921 A 4/1987 Karpa
4,741,577 A 5/1988 Sato et al.
4,763,544 A 8/1988 Blakemore
4,805,451 A 2/1989 Leon
4,827,765 A 5/1989 Kessler
4,889,202 A 12/1989 Bron
4,922,922 A 5/1990 Pollock et al.
4,973,226 A 11/1990 McKee
4,974,675 A 12/1990 Austin et al.
4,983,090 A 1/1991 Lehmann et al.
4,996,882 A 3/1991 Kistler
5,050,690 A 9/1991 Smith
5,064,349 A 11/1991 Turner et al.
5,167,490 A 12/1992 McKee et al.
5,172,591 A 12/1992 Bohon
5,199,198 A 4/1993 Godbout
5,237,863 A 8/1993 Dunham
5,423,222 A 6/1995 Rudd et al.
5,475,615 A 12/1995 Lin
5,559,547 A 9/1996 Hagar
5,569,860 A 10/1996 Aizawa et al.
5,698,085 A 12/1997 Yu
5,722,807 A 3/1998 Hodge
5,811,750 A 9/1998 Caprioglio
5,857,530 A 1/1999 Gronseth
6,081,880 A 6/2000 Sollars
6,155,347 A 12/2000 Mills
6,216,547 B1 4/2001 Lehtovaara
6,253,626 B1 7/2001 Shoberg et al.
6,292,537 B1 9/2001 Zimmermann
6,374,186 B1 4/2002 Dvorkin et al.
6,521,469 B1 2/2003 La Rosa et al.
6,775,966 B2 8/2004 Frego
6,837,342 B1 1/2005 Olschewki et al.
6,921,120 B1 7/2005 Ervin
6,937,921 B1 8/2005 Mazumder
7,500,390 B2 3/2009 Mills
7,647,773 B1 1/2010 Koenig
7,935,876 B1 5/2011 West
8,126,689 B2 2/2012 Soliman et al.
8,157,537 B2 4/2012 Chavez Zapata
8,797,033 B1 * 8/2014 Girrell ..... E21B 29/00 324/309
2002/0040963 A1 4/2002 Clayton et al.
2002/0070050 A1 6/2002 Wassell
2002/0144968 A1 10/2002 Ruddy
2002/0166965 A1 11/2002 Matsuda et al.
2003/0089177 A1 5/2003 Luthje et al.
2003/0140710 A1 7/2003 Nakayama et al.
2003/0150263 A1 8/2003 Economides et al.
2003/0163257 A1 8/2003 Ravi et al.
2003/0173958 A1 * 9/2003 Goldfine ..... G01N 27/904 324/209
2004/0016295 A1 1/2004 Skinner et al.
2004/0047289 A1 3/2004 Azami et al.
2004/0056654 A1 * 3/2004 Goldfine ..... G01N 27/9013 324/239
2004/0139806 A1 7/2004 Christmas
2004/0221985 A1 11/2004 Hill et al.
2004/0231429 A1 11/2004 Niezgorski et al.
2004/0246816 A1 12/2004 Ogle
2005/0211430 A1 9/2005 Patton et al.
2006/0225523 A1 10/2006 Reddy et al.
2006/0271299 A1 11/2006 Ward et al.
2007/0007955 A1 * 1/2007 Goldfine ..... G01N 27/82 324/240
2007/0013619 A1 1/2007 Watanabe et al.
2007/0067092 A1 3/2007 Burkatovsky
2007/0172357 A1 7/2007 Saito et al.
2007/0183260 A1 8/2007 Lee et al.
2007/0222438 A1 * 9/2007 Reeves ..... G01N 27/82 324/240
2008/0034134 A1 2/2008 Kumar
2008/0035376 A1 2/2008 Freyer
2008/0123079 A1 5/2008 Numata et al.
2008/0123719 A1 5/2008 Lee et al.
2008/0216554 A1 9/2008 McKee
2008/0225710 A1 9/2008 Raja et al.
2008/0271541 A1 11/2008 Neuman
2008/0314577 A1 12/2008 Adamek
2009/0063054 A1 3/2009 Newman
2009/0071645 A1 3/2009 Kenison et al.
2009/0151330 A1 6/2009 Chamarthi et al.
2009/0194273 A1 8/2009 Surjaatmadja et al.
2010/0088076 A1 4/2010 Koutsabeloulis et al.
2010/0135170 A1 6/2010 Fan et al.
2010/0218941 A1 9/2010 Ramurthy et al.
2010/0262048 A1 10/2010 Shinomiya et al.
2010/0300886 A1 12/2010 Lin et al.
2010/0307766 A1 12/2010 Kampman et al.
2010/0319910 A1 12/2010 Ives et al.
2011/0024188 A1 2/2011 Wassell et al.
2011/0048737 A1 3/2011 Schneider
2011/0090496 A1 4/2011 Samson et al.
2011/0132662 A1 6/2011 Dennis
2011/0132663 A1 6/2011 Johnston et al.
2011/0313626 A1 12/2011 Bowen et al.
2012/0016589 A1 1/2012 Li et al.
2012/0101395 A1 4/2012 Fujita et al.
2012/0103248 A1 5/2012 Hickman
2012/0132467 A1 5/2012 Zeineddine
2012/0152024 A1 6/2012 Johansen
2012/0289866 A1 11/2012 Irby et al.
2014/0014334 A1 * 1/2014 Mason ..... E21B 33/035 166/255.1

FOREIGN PATENT DOCUMENTS

DE 102004044464 A1 3/2006
EP 1193261 A1 4/2002
EP 1512311 B1 10/2005
EP 1313400 B1 11/2005
EP 1733994 A1 12/2006
EP 1968184 A2 9/2008
EP 1931856 B1 4/2010
FR 2592952 A1 7/1987
GB 930912 A 7/1963
GB 2091817 A 8/1982
GB 2273865 A 7/1994
GB 2330889 A 5/1995
JP 2000060846 A 2/2000
JP 2000065762 A 3/2000
JP 2000111393 A 4/2000
JP 2000211839 A 8/2000
JP 2000287949 A 10/2000
JP 2000353860 A 12/2000
JP 2001059803 A 3/2001
JP 2001133229 A 5/2001
JP 2002191072 A 7/2002
JP 2002263432 A 9/2002
JP 2003177011 A 6/2003
JP 2004251863 A 9/2004
JP 2005002564 A 1/2005
JP 2005083961 A 3/2005

(56) References Cited

FOREIGN PATENT DOCUMENTS

| | | | |
|---|---|---|---|
| JP | 3110605 | U | 5/2005 |
| JP | 2007212844 | A | 8/2007 |
| JP | 2009104564 | | 5/2009 |
| JP | 2012011482 | | 1/2012 |
| JP | 2012077726 | | 4/2012 |
| JP | 2012088270 | | 5/2012 |
| JP | 2012088271 | | 5/2012 |
| JP | 5256683 | B2 | 8/2013 |
| WO | 8202954 | A1 | 9/1982 |
| WO | 8906351 | A1 | 7/1989 |
| WO | 9824933 | A1 | 6/1998 |
| WO | 9825015 | A2 | 6/1998 |
| WO | 0139284 | A1 | 5/2001 |
| WO | 2007003162 | A1 | 1/2007 |
| WO | 2007126332 | A1 | 11/2007 |
| WO | 2007126333 | A1 | 11/2007 |
| WO | 2008003577 | A1 | 1/2008 |
| WO | 2008009794 | A1 | 1/2008 |
| WO | 2011017415 | A2 | 2/2011 |
| WO | 2011057817 | A2 | 5/2011 |
| WO | 2011122955 | A1 | 10/2011 |
| WO | 2011159307 | A1 | 12/2011 |
| WO | 2012047678 | A2 | 4/2012 |
| WO | 2012079906 | A1 | 6/2012 |
| WO | 2012087604 | A2 | 6/2012 |
| WO | 2012107108 | A1 | 8/2012 |

OTHER PUBLICATIONS

Ward et al., "Evaluation of Wellhead Fatigue Using In-Service Structural Monitoring Data (OTC 23981)", Offshore Technology Conference, Houston, Texas, USA, pp. 1-13, May 6, 2013.

Koshhny, Marco et al., "Magneto-Optical Sensors Accurately Analyze Magnetic Field Distribution of Magnetic Materials", Advanced Materials & Processes, Feb. 2012, pp. 13-16.

* cited by examiner

SENSING MAGNETIZED PORTIONS OF A WELLHEAD SYSTEM TO MONITOR FATIGUE LOADING

BACKGROUND OF THE INVENTION

1. Field of Invention

The present disclosure relates in general to monitoring fatigue loading in a component of a wellhead system by sensing a magnetized portion of the component. The disclosure further relates to magnetizing the component in strategic locations and disposing sensors proximate the magnetized locations.

2. Description of Prior Art

Wellheads used in the production of hydrocarbons extracted from subterranean formations typically comprise a wellhead assembly attached at the upper end of a wellbore formed into a hydrocarbon producing formation. Wellhead assemblies usually provide support hangers for suspending strings of production tubing and casing into the wellbore. A string of casing usually lines the wellbore, thereby isolating the wellbore from the surrounding formation. The tubing typically lies concentric within the casing and provides a conduit therein for producing the hydrocarbons entrained within the formation. A production tree is usually provided atop a wellhead housing, and is commonly used to control and distribute the fluids produced from the wellbore and selectively provide fluid communication or access to the tubing, casing, and/or annuluses between strings of concentric tubing and casing.

Wellhead housings, especially those subsea, typically include an outer low pressure housing welded onto a conductor pipe, where the conductor pipe is installed to a first depth in the well, usually by driving or jetting the conductor pipe. A drill bit inserts through the installed conductor pipe for drilling the well deeper to a second depth so that a high pressure housing can land within the low pressure housing. The high pressure housing usually has a length of pipe welded onto its lower end that extends into the wellbore past a lower end of the conductor pipe. The well is then drilled to its ultimate depth and completed, where completion includes landing casing strings in the high pressure housing that lines the wellbore, cementing between the casing string and wellbore wall, and landing production tubing within the production casing.

Once in operation, forces externally applied to the wellhead assembly such as from drilling, completion, workover operations, waves, and sea currents, can generate bending moments on the high and low pressure housings. As the widths of the low and high pressure housings reduce proximate attachment to the conductor pipes, stresses can concentrate along this change of thickness. Over time, repeated bending moments and other applied forces can fatigue load components of the wellhead assembly. Thus the safety of using a wellhead after ten years of operation is sometimes questioned; which can lead to the expensive option of replacing the aged wellhead. Moreover, the inability to directly measure wellhead fatigue sometimes requires a higher class welding connection, which can be unnecessarily expensive. Monitoring fatigue in a wellhead assembly remains a challenge for the industry. Strain gages have been used for measuring strain in a wellhead assembly, but they often become detached when subjected to the harsh environment within a wellhead assembly. Excessive wires/cables were hard to handle for sensor communication under the subsea environment. Finite element models have been used for fatigue analysis, but most require a transfer function to extrapolate the measured load of riser which is connected to the wellhead. The lack of the real fatigue data from the field had contributed to the uncertainty of the finite element analysis result.

SUMMARY OF THE INVENTION

Disclosed herein is a method and apparatus for wellbore operations that includes a real time analysis of fatigue loading of components of a wellhead assembly. In one example a method of operating a wellbore includes sensing a magnetic field that intersects a portion of a tubular that is in the wellbore and that forms part of a wellhead assembly. Variations in the magnetic field are identified that are from loads applied to the tubular, and fatigue loading on the tubular is estimated based on the applied loads. The method can included magnetizing a selected portion of the tubular to form magnetic field. In this example, the magnetized portion of the tubular resembles an oval shape. Further, the oval shape can have an elongate side oriented in a direction that is parallel with an axis of the wellbore, oblique with an axis of the wellbore, or perpendicular with an axis of the wellbore. Optionally, the step of sensing includes providing a sensor in the magnetic field and monitoring an output of the sensor. The sensor can be part of a sensor system with a plurality of sensors connected by a sensing line, and wherein the sensors sense a change in the magnetic field. The sensing line can be made up of an optical fiber, electrical line, cable, or combinations thereof; and the sensors can be magneto-optic sensors, solid state magnetic sensors, inductive sensors, or combinations thereof. In an example, the change in the magnetic field is a change in the magnitude of the magnetic field. Also, an operating life of the tubular can be estimated based on the information gathered. The tubular can be a component of the wellhead assembly, such as a low pressure housing, a low pressure conductor pipe; a high pressure housing, a high pressure conductor pipe, a casing hanger, a tubing hanger, a length of casing, or a length of production tubing.

In a further embodiment, a method of wellbore operations includes sensing a characteristic of a magnetic field from a magnetized portion of a tubular that is in the wellbore and that forms part of a wellhead assembly, identifying changes in the characteristic of the magnetic field that are caused by a stress in the tubular, estimating real time fatigue damage to the tubular based on the identified changes in the characteristic of the magnetic field, and preparing a real time structural confirmation analysis of the tubular. A fatigue failure of the tubular can be estimated from the collected information, as well as a prediction of a residual life of the tubular. Moreover, a different wellhead assembly can be designed based on changes in the characteristic of the magnetic field that are caused by stresses experienced by the tubular over time. In one example, the magnetized portion of the tubular is strategically disposed proximate a change in thickness of the tubular, proximate a weld in the tubular, or both.

Further disclosed herein is a wellhead assembly that includes a tubular with magnetized locations strategically positioned thereon and that form magnetic fields, where the magnetic fields project outward from the tubular. A sensor system is included that is made up of sensors disposed in the magnetic fields and that generate signals in response to changes in the magnetic fields. An intelligent information processing system is included that is in communication with the sensor system; which can include a processor for correlating the changes in the magnetic fields to loads experienced by the tubular.

BRIEF DESCRIPTION OF DRAWINGS

Some of the features and benefits of the present invention having been stated, others will become apparent as the description proceeds when taken in conjunction with the accompanying drawings, in which.

Figure 1A:
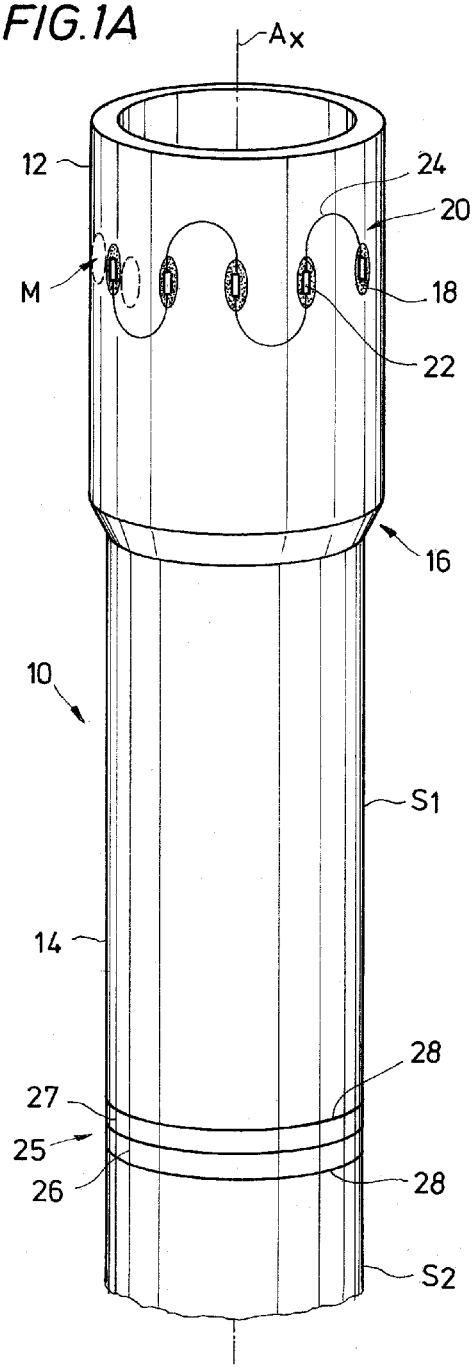
FIG. 1A is a side perspective view of a wellhead tubular having selected portions that are magnetized, and a sensor system for measuring changes in a magnetized portion on an outer surface, and in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in perspective view in FIG. 1A is an example of a tubular 10 that includes a housing portion 12 and a lower diameter conductor portion 14 depending from one end of the housing portion 12. A transition 16 connects the housing and conductor portions 12, 14; and accounts for the changes in diameter of these respective portions with side walls that depend radially inward away from housing portion 12 and in a direction towards an axis $A_X$ of tubular 10. A series of magnetized areas 18 are shown formed at various locations on an outer surface of tubular 10. In one example the magnetized areas 18 each have regions with different polarities so that a magnetic field M is generated proximate each areas 18, which projects outward from the tubular 10. A characteristic of the magnetic field M can change in response to stresses within the material of the tubular 10 that occurs in one of the magnetized areas 18. These stresses may be induced by compression or tension in the tubular 10. One characteristic that is altered is the magnitude of the magnetic field, which can be measured in units of Gauss or Tesla.

A sensor system 20 is shown mounted adjacent the tubular 10 that includes sensors 22 disposed proximate to the magnetized areas 18. Embodiments exist wherein each magnetized area 18 includes a corresponding sensor 22, but not shown herein for the sake of clarity. In the example of FIG. 1, sensor line 24 extends between adjacent sensors 22, wherein line 24 may be arranged in the curved fashion as shown. In some examples, a designated amount of sensor line 24 is required to be provided between adjacent sensors 22 to ensure proper operation of sensors 22. Example sensors 22 include magneto-optic sensors, solid state magnetic sensors, such as Hall effect sensors and inductive sensors. A further example of a sensor includes optical fibers that are locally coated with a magnetostrictive material. As will be described in more detail below, the sensors 22 are responsive to changes in the magnetic field M and will emit a corresponding signal communicated through sensor line 24 which can be analyzed real time, or stored and used for creating historical data.

Figure 1B:
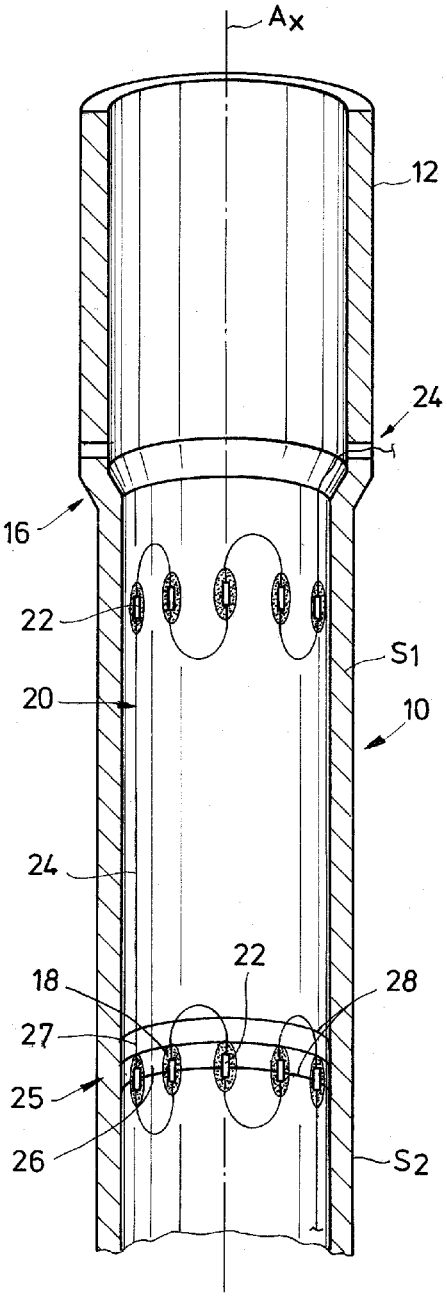
FIG. 1B is a sectional view of the wellhead tubular of FIG. 1A with the sensor system on an inner surface, and in accordance with the present invention.

As noted above, the magnetized areas 18 are strategically located on the tubular 10 in locations that may be of interest to assess applied loads onto the tubular 10, which in one case may be adjacent a box/pin connection 25 shown formed on conductor portion 14. As is known, conductor 14 can be formed from a string of individual segments $S_1$, $S_2$ connected by box/pin connection 25. Welds 28 are shown connecting the individual box and pin portions 26, 27 to adjacent conductor segments $S_1$, $S_2$; magnetized areas 18 are shown provided adjacent welds 28. FIG. 1B illustrates tubular 10 in a sectional view with magnetized areas 18 provided adjacent box/pin connection 25, and sensors 22 disposed adjacent magnetized areas 18. The example of sensor system 20 of FIG. 1B includes line 24 that connects to sensors 22 proximate box/pin connection 25, line 24 also connects to sensors 22 disposed adjacent magnetized areas 18 between box/pin connection 25 and transition 16. Line 24 exits from within tubular 10 through a passage 29 that is formed radially through housing portion 12.

Figure 2:
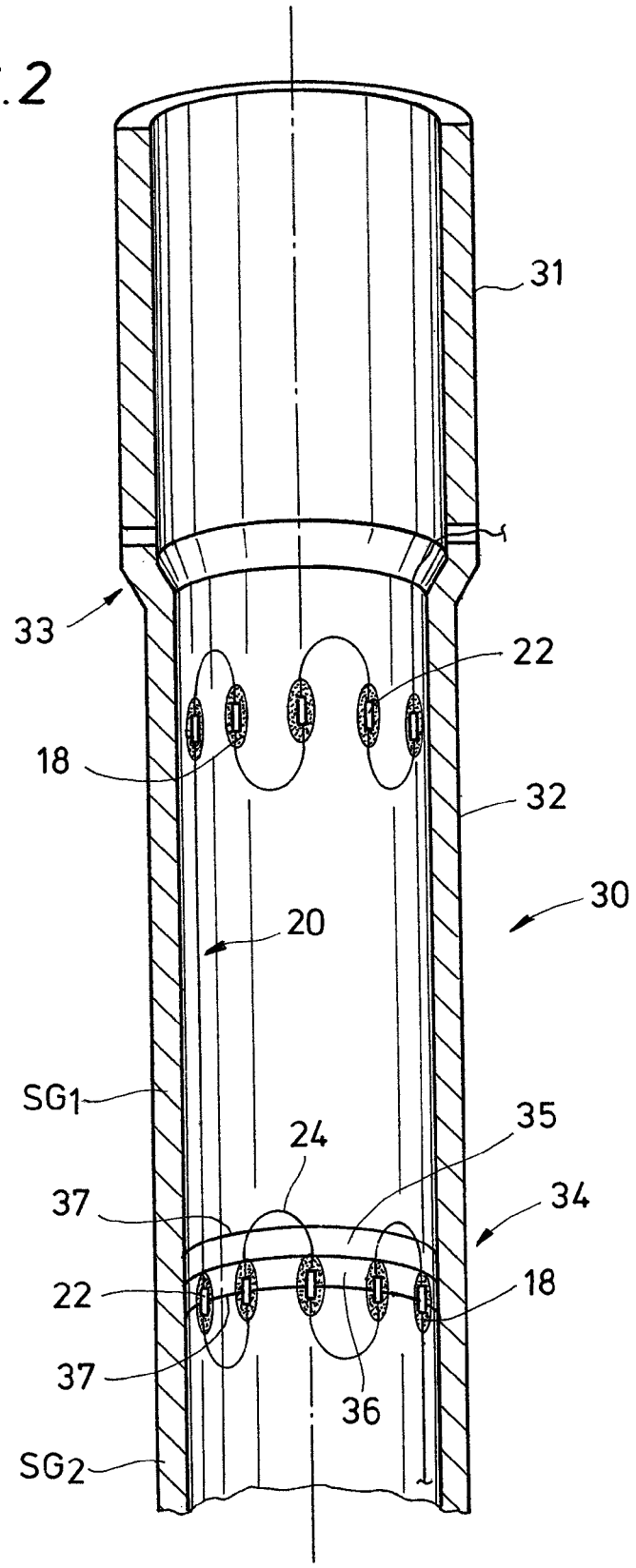
FIG. 2 is a sectional view of a wellhead tubular having selected portions that are magnetized, and a sensor system for measuring changes in magnetized portion on an inner surface, and in accordance with the present invention.

Referring now to FIG. 2, a sectional view is shown of a tubular 30 that includes a housing portion 31 coupled to a smaller diameter elongate conductor portion 32 by a transition 33 that projects radially inward to compensate for the differences in diameters of the housing 31 and conductor 32 portions. Tubular 30 also includes magnetized areas 18; the magnetized areas 18 of FIG. 2 though are shown provided on an inner surface of tubular 30. Also included in the embodiment of FIG. 2 is a sensor system 20 with sensors 22 proximate some of the magnetized areas 18 and connected by a sensor line 24 for communicating sensed changes in magnetic field characteristic for analysis. While embodiments exist where sensors 22 are provided next to each magnetized area 18, some sensors 22 are omitted in order to improve clarity of the figure. In one example, tubular 30 of FIG. 2 is a low pressure housing, whereas tubular 10 of FIG. 1 is a high pressure housing. Similar to tubular 10, tubular 30 includes a box/pin connection 34 between segments $SG_1$, $SG_2$; where box/pin connection 34 includes a box portion 35 threaded to a pin portion 36. Welds 37 connect box portion 35 to segment $SG_1$ and connects pin portion 36 to $SG_2$. Sensor system 20 of FIG. 2, similar to sensor system 20 of FIG. 1B, includes sensors 22 proximate magnetized areas 18 along the box/pin connection 34 and on conductor portion 32 and spaced away from transition 33. Line 24 connects to the sensors 22 and exits through a passage 38 formed radially through conductor portion 31.

Figure 3:
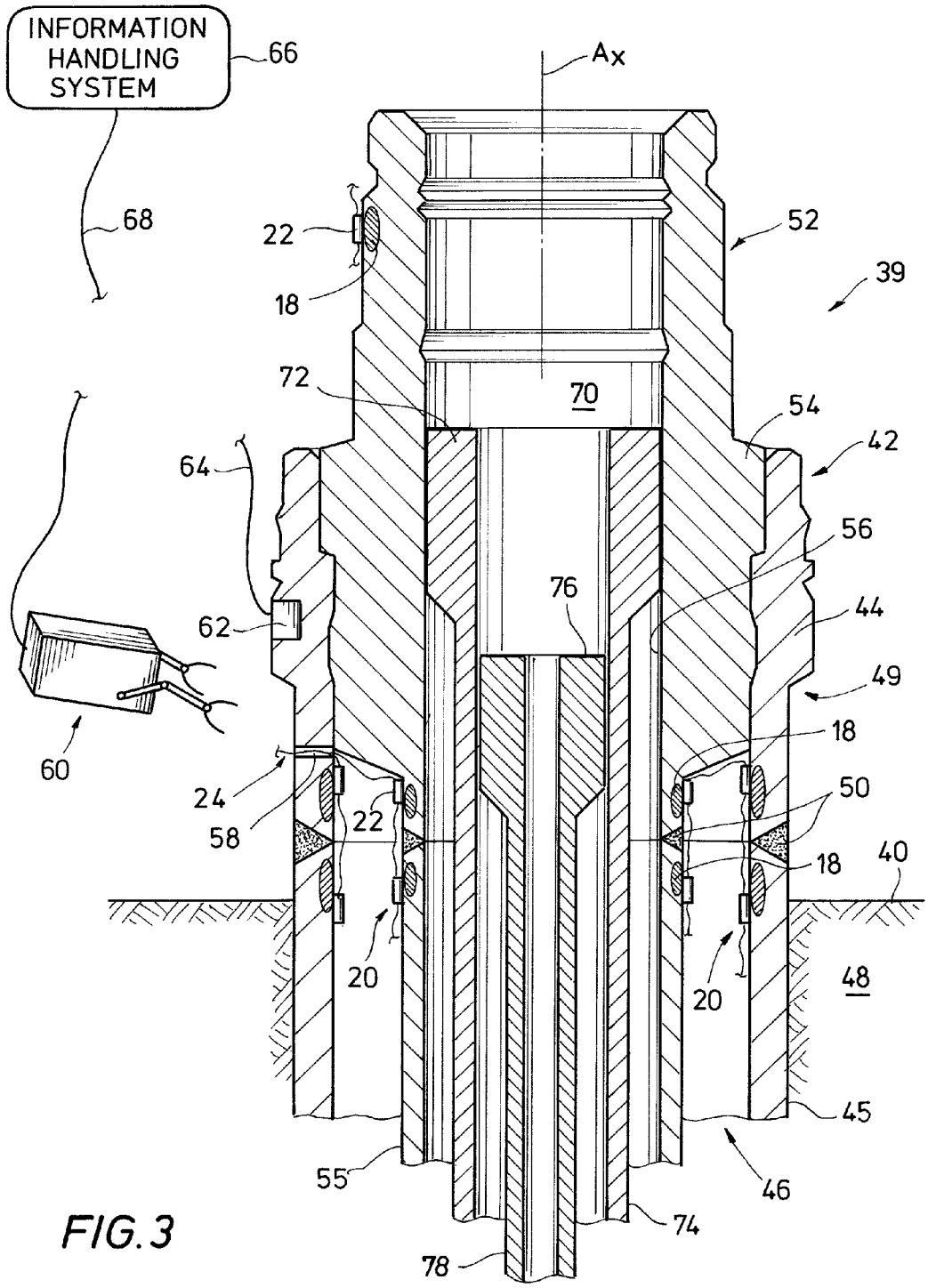
FIG. 3 is a sectional view of a subsea wellhead with tubulars from FIGS. 1 and 2 and in accordance with the present invention.

FIG. 3 provides in section view one example of a wellhead assembly 39 disposed on the sea floor 40. In this example, wellhead assembly 39 includes a low pressure tubular 42 along its outer circumference which includes a low pressure housing 44 coupled to a conductor pipe 45. Conductor pipe 45 extends downward from low pressure housing 44 and into a wellbore 46 that is formed through a formation 48 beneath sea floor 40. A transition 49, shown having a thickness reduction with distance from low pressure tubular 42, connects low pressure housing 44 and conductor 45. A weld 50 shown providing connection between conductor 45 and transition 49.

Coaxially disposed within low pressure tubular 42 is a high pressure tubular 52 that includes a high pressure housing 54 shown set coaxially within low pressure housing 44. Similar to the low pressure tubular 42, a conductor 55 depends downward from high pressure housing 54 into wellbore 46. A weld 50 connects an upper end of conductor 55 with a transition 56, which couples to a lower end of high pressure housing 54. Similar to transition 49, high pressure transition 56 has a thickness that reduces with distance from high pressure housing 54. Further in example of FIG. 3, magnetized areas 18 are shown provided at strategic locations on the tubulars 42, 52. More specifically, magnetized areas 18 are formed on an inner surface of low pressure tubular 42, which in one example provides some protection for the associated sensor systems 20 during installation of low pressure housing 42 within wellbore 46. An outer surface of high pressure tubular 52 is shown having magnetized areas 18 and with sensor systems 20 set along those areas so that its sensors 22 can sense magnetic field changes that occur when stresses are applied to tubular 52.

Further in the example of FIG. 3, a passage 58 is shown formed radially through the low pressure tubular 42, in which sensor lines 24 from the sensor systems 20 are routed to outside of the wellhead assembly 39. Thus signals from the sensor systems 20 can be transmitted to a location remote from the wellhead assembly 39 for monitoring and analysis. Optionally, a remotely operated vehicle (ROV) 60 may be provided subsea and used to manipulate the sensor lines 24 outside of wellhead assembly 39 and connect to a connector (not shown) to complete a communication link to above the sea surface. Optionally, a communication pod 62 is provided on an outer surface of wellhead assembly 39 and which may connect to sensor lines 24 for communication such as through a communication line 64 shown coupled to a side of communication pod 62.

An information handling system (IHS) 66 is schematically illustrated in FIG. 3 and coupled to a communication line 68 which is configured for receiving data signals from sensors 22. The IHS 66 includes one or more of the following exemplary devices, a computer, a processor, a data storage device accessible by the processor, a controller, nonvolatile storage area accessible by the processor, software, firmware, or other logic for performing each of the steps described herein, and combinations thereof. The IHS 66 can be subsea, remote from the wellhead assembly 39 (either subsea or above the sea surface), a production rig, or a remote facility. Examples exist wherein IHS 66 is in real time constant communication with sensor systems 20. Data signals from the sensors 22 can be transmitted to IHS 66 through line 24, communication line 64, or via telemetry generated from subsea. In an example, data signals received by IHS 66 are processed by HIS 66 to estimate fatigue in the magnetized material, and also in the material adjacent the magnetized areas 18. Optionally, IHS 66 is used to estimate damage from fatigue in the structure being monitored with the sensors 22. Moreover, in an example, a loading history of the monitored structure is generated by monitoring/collecting data signals from the sensors 22, which is used to estimate fatigue damage in the monitored structure.

Still referring to FIG. 3, an inner circumference of high pressure tubular 52 defines a main bore 70, which is generally coaxial with an axis $A_X$ of wellhead assembly 39 and in which a casing hanger 72 may optionally be included with wellhead assembly 39. Production casing 74 is shown depending into wellbore 46 from a lower end of casing hanger 72. Optionally, a tubing hanger 76 may be landed within casing 74 and from which production tubing 78 projects into wellbore 46 and that is coaxial with casing 74. Embodiments exist wherein magnetized areas 18 are provided onto selected locations within hangers 72, 76, casing 74, and/or tubing 78 for monitoring stresses and other loads applied to these elements.

In one example of operation, the magnetized areas 18 may be formed onto the wellhead members (i.e. tubulars 10, 30, 42, 52, hangers 72, 76, casing 74 and/or tubing 78) by applying a pulse of high current with electrodes (not shown) that are set onto the particular wellhead member. This example is sometimes referred to as electrical current pulse magnetization. Strategic placement of the electrodes can form shapes of the magnetized areas as desired. In the examples of FIGS. 1 through 3, the magnetized areas 18 are shown as oval shaped and having an elongate side oriented generally parallel within an axis of its associated tubular 10, 30, 42, 52, or wellhead assembly 39. However, embodiments exist wherein the elongate sides are generally oblique to these axes, or perpendicular to the axis and extending circumferentially around the associated tubular member. Other magnetization techniques may be employed, such as placement of permanent magnets within the wellhead member as well as formation of an electromagnet. In examples wherein magnetized areas are disposed proximate to a weld, the particular weld is performed prior to the step of magnetizing the tubular member to form these magnetized area. In an optional embodiment, magnetization occurs prior to mechanical assembly, such as the threaded connection of a box and pin connection 25 of FIG. 1. In an example, the magnetic field M (FIG. 1) projecting from the magnetized areas 18 has characteristics that vary when stress is applied to the material of the magnetized area 18. The stress can be as a result of tension or compression.

One example of calibrating a sensor system 20 (FIGS. 1-3) includes applying a known stress to a member, such as a tubular, having a magnetized area and monitoring changes in the magnetic field associated with the magnetized area. This example of calibration can include taking into account the dimensions of the material, type of material, temperature of the member, and size of the magnetized area. Knowing the value or values of applied stress or stresses with an amount or amounts of measured change in magnetic field can yield data for correlating measurements of magnetic field changes from tubulars installed in a wellhead assembly to values of applied stress. Thus by installing a wellhead assembly having magnetized areas and sensor assemblies, real time loading data can be collected and ultimately used for creating a fatigue analysis of the tubulars within the wellhead assembly. Fatigue analysis can then be used for assessing the structural integrity of tubulars within the wellhead assembly as well as predicting when a fatigue failure may occur. As such, the useful life of an entire wellhead assembly 39 (FIG. 3) can be estimated using the method and system described herein. Moreover, data obtained from one or more wellhead assemblies in a particular wellbore, can be used for designing a wellhead assembly that is to be installed and used in a different wellbore. Further, known methods are in place so that a single line can extend between multiple sensors, wherein the sensors are in series, and yet knowing the time delay of a signal after applying a pulse through the signal line, a particular sensor at a particular location can be identified from which the designated signal is obtained.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the apparatus and method described herein can be used to monitor fatigue in a structure or material of any shape, that can be magnetized or have a portion that emits a magnetic field; and is not limited to material disposed in a wellbore or used in conjunction with wellbore operations. These and other similar modifications will readily suggest themselves to those skilled in the art, and are intended to be encompassed within the spirit of the present invention disclosed herein and the scope of the appended claims.

What is claimed is:

1. A method of monitoring a wellhead component of a wellhead system, comprising:

providing at least one magnetized area on the wellhead component, the magnetized area having a magnetic field that varies in response to loads applied to the wellhead component;

mounting at least one sensor to the wellhead component proximate to the magnetized area;

sensing with the sensor the magnetic field of the previously magnetized area;

with an information handling system linked to the sensor, identifying variations in the magnetic field that are from cyclic loads applied to the wellhead component; and estimating fatigue damage on the wellhead system based on the cyclic loads.

2. The method of claim 1, wherein the magnetized area of the wellhead component resembles an oval shape.

3. The method of claim 2, wherein the oval shape has an elongate side oriented in a direction selected from the group consisting of parallel with an axis of the wellhead component, oblique with an axis of the wellhead component, and perpendicular with an axis of the wellhead component.

4. The method of claim 1, wherein the wellhead component is stationary after installation within the wellhead system.

5. The method of claim 1, wherein:

providing at least one magnetized area comprises providing a plurality of magnetized areas on the tubular;

mounting at least one sensor comprises affixing a plurality of sensors to the wellhead component, each of the sensors being proximate to one of the magnetized areas; and the method further comprises connecting the sensors to each other by a sensing line.

6. The method of claim 5, wherein the sensing line comprises a line selected from the group consisting of an optical fiber, an electrical line, a cable, and combinations thereof, and the sensors comprise a magnetically sensitive element selected from the group consisting of a magneto-optic sensor, a solid state magnetic sensor, an inductive sensor, and combinations thereof.

7. The method of claim 1, wherein the variations in the magnetic field comprise changes in the magnitude of the magnetic field.

8. The method of claim 1, further comprising with the information handling system, estimating a useful operating life of the wellhead system based on the fatigue damage estimated.

9. The method of claim 1, wherein the wellhead component is selected from a group consisting of a low pressure housing, a low pressure conductor pipe; a high pressure housing, a high pressure conductor pipe, a casing hanger, a tubing hanger, a length of casing, a length of production tubing.

10. A method of monitoring a tubular of wellhead system, comprising:

a. sensing a characteristic of a magnetic field from a magnetized portion of the tubular;

b. identifying changes in the characteristic of the magnetic field that are caused by a stress in the tubular;

c. estimating real time fatigue damage to the tubular based on the identified changes in the characteristic of the magnetic field;

d. preparing a real time structural integrity analysis of the tubular; and wherein the magnetized portion of the tubular is strategically disposed at a location selected from the group consisting of proximate a change in thickness of the tubular, proximate a weld in the tubular, and combinations thereof.

11. The method of claim 10, further comprising predicting a fatigue failure of the tubular.

12. The method of claim 10, predicting a residual life of the tubular.

13. The method of claim 10, wherein the wellhead assembly is a first wellhead assembly, the method further comprises designing a second wellhead assembly based on changes in the characteristic of the magnetic field that are caused by stresses experienced by the tubular over time.

14. The method of claim 10, further comprising providing a real time location of fatigue damage on the tubular.

15. A wellhead assembly comprising:

a stationary tubular having strategically positioned previously magnetized locations forming magnetic fields that project from the tubular;

a sensor system having sensors mounted to the tubular, disposed in the magnetic fields, and that generate signals in response to changes in the magnetic fields occurring in response to changes in stress within the tubular; and an information handling system in communication with the sensor system for receiving the signals from the sensors.

16. The wellhead assembly of claim 15, further comprising a processor in the information handling system for correlating the changes in the magnetic fields to loads experienced by the tubular.

17. The assembly according to claim 15, further comprising:

signal lines extending between adjacent ones of the sensors for communicating the signals to the information handling system.

18. The assembly according to claim 15, wherein:

each of the magnetized locations is oval-shaped.

* * * * *